United States Patent [19]

Ose et al.

[11] Patent Number: 4,993,981

[45] Date of Patent: Feb. 19, 1991

[54] METHOD OF MANUFACTURING VAPORIZED METAL DISCHARGE LAMP

[75] Inventors: Akira Ose; Shinya Omori, both of Yokohama; Akihiko Tsurumaru, Tokyo, all of Japan

[73] Assignee: Stanley Electric Co., Ltd., Tokyo, Japan

[21] Appl. No.: 463,001

[22] Filed: Jan. 8, 1990

Related U.S. Application Data

[63] Continuation-in-part of Ser. No. 254,410, Oct. 6, 1988, abandoned.

[30] Foreign Application Priority Data

Oct. 12, 1987 [JP] Japan ..... 62-256877

[51] Int. Cl.[5] ..... H01J 9/38

[52] U.S. Cl. ..... 445/9; 445/19; 445/70; 445/73

[58] Field of Search ..... 445/9, 10, 14, 15, 16, 445/17, 70, 73

[56] References Cited

U.S. PATENT DOCUMENTS

| | | | |
|---|---|---|---|
| 1,881,616 | 10/1932 | Ives | 445/9 |
| 2,733,115 | 1/1956 | Vine | 445/73 |
| 2,744,808 | 5/1956 | Ruedy | 445/73 |
| 3,328,108 | 6/1967 | Keenan | 445/70 |
| 3,572,877 | 3/1971 | Ogawa | 445/70 |
| 3,667,513 | 6/1972 | Della Porta | 445/73 |
| 4,671,778 | 6/1987 | Musselman | 445/73 |
| 4,799,912 | 1/1989 | Salgó445 | 70/ |

*Primary Examiner*—Kurt Rowan

*Attorney, Agent, or Firm*—Frishauf, Holtz, Goodman & Woodward

[57] ABSTRACT

A method of manufacturing a vaporized metal discharge lamp wherein a metal halide is attached to the tip of a metal rod, such as through vapor deposition or sputtering. The rod is then inserted into a light emission envelope of the lamp, and the metal halide attached to the metal rod tip is transferred to the inside of the envelope through high frequency induction heating.

15 Claims, 1 Drawing Sheet

FIG.1
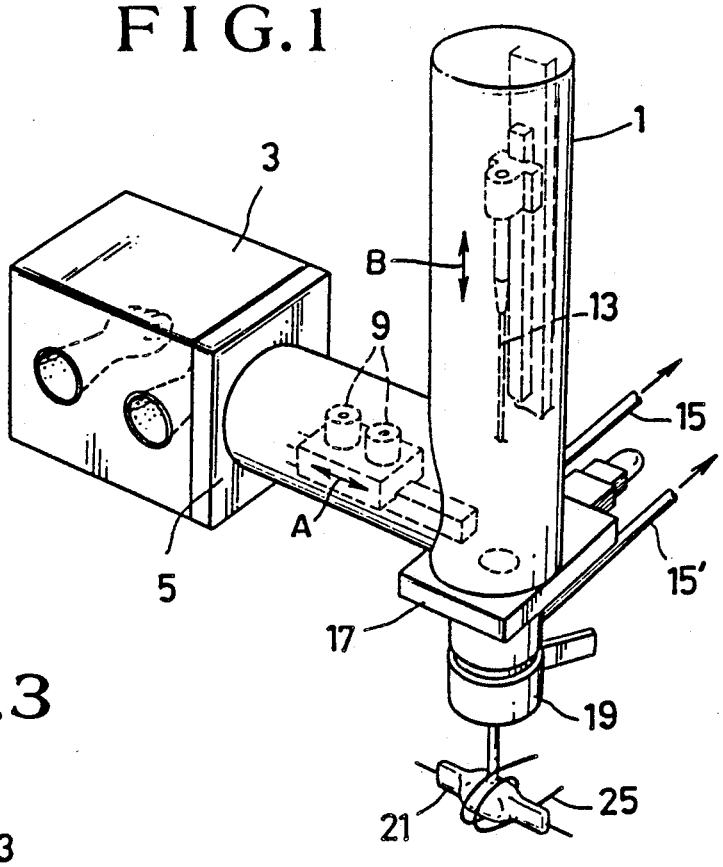
FIG.3
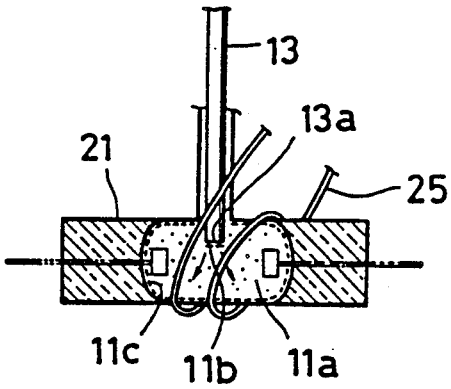
FIG.2
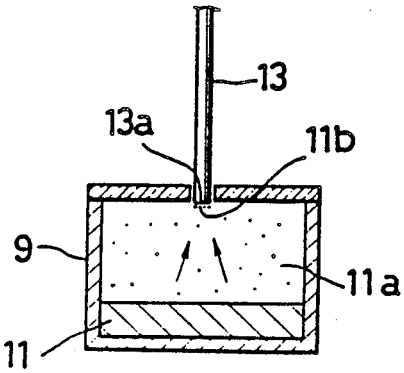
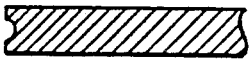
FIG. 4
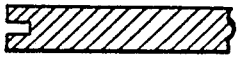
FIG. 5

METHOD OF MANUFACTURING VAPORIZED METAL DISCHARGE LAMP

CROSS REFERENCE TO RELATED APPLICATION

This application is a Continuation-In-Part of prior application Ser. No. 07/254,410, filed Oct. 6, 1988, now abandoned.

BACKGROUND OF THE INVENTION

The present invention relates to a vaporized metal discharge lamp of the type wherein mercury, inert gas and metal halides are filled in a transparent light emission envelope having electrodes mounted thereon, and more particularly to a method of filling metal halides in the envelope.

Generally, metals such as thallium, sodium, indium and the like are filled in the form of metal halides in the light emission envelope of a high pressure mercury discharge lamp, to improve light emission efficiency, color rendition and the like. However, of the metal halides, there is used a substance which has a high moisture absorption characteristic, such as indium iodide so that it cannot be exposed to atmospheric air. Thus, the method of manufacturing a vaporized metal discharge lamp has been made complicated.

According to a most common manufacturing method, granular metal halides previously dehydrated and weighed are first filled in a light emission envelope within a dry box under an inert gas atmosphere. Next, the light emission envelope is air tightly sealed from external atmospheric air by proper means and coupled to an air exhaust device to exhaust air from within the light emission envelope. Thereafter a series of processes including mercury dropping, inert gas introducing, and sealing are carried out, thus resulting in a complicated manufacturing procedure.

In Japanese Patent Publication Nos. 40-19548, 43-17787, 46-19390 and others there has been proposed a manufacturing method whereby a metal halide pool is formed at the air exhaust pipe or at the sealing member, and the metal halide is heated while exhausting air via the air exhaust pipe to dehydrate it and vaporize it so as to make it easy to be moved. Then, such metal halide is introduced into the light emission envelope previously cooled, and is concentrated within the envelope.

Further, in Japanese Patent Publication No. 54-14874, a manufacturing method has been proposed whereby a metal halide dropping device is mounted in the air exhaust system to drop it into the light emission envelope.

In spite of the complicated and inefficient conventional method described above, it is still difficult to completely remove water, oxygen and the like adsorbed on the surfaces of jigs and the like within the dry box, and of jigs and the like for maintaining air tightness of the light emission envelope. These substances are adsorbed by the metal halide, resulting in the disadvantages such as an extraordinarily high discharge start voltage, early blackening of the envelope, and inactivation of the lamp. These disadvantages have not been eliminated to date.

According to the manufacturing method disclosed in Japanese Patent Publication Nos. 40-19548, 43-17787, and 46-19390, the metal halide does not contact the atmospheric air so that the conventional disadvantages such as an extraordinarily high discharge voltage, early blackening of the envelope, and inactivation of the lamp have been eliminated. However, it has been found that there arises a new problem in that it is very difficult to fill reliably a predetermined amount of metal halide in the light emission envelope. In particular, even if a metal halide precisely weighed is placed in the metal halide pool, the vapor of heated metal halide will be concentrated, during transfer thereof, at the low temperature areas not only within the light emission envelope but also within an introduction pipe, air exhaust pipe and the like. Thus, all the metal halide previously weighed cannot be concentrated within the light emission envelope. The fluctuation of the filling amount of metal halide becomes more conspicuous as the light emission envelope becomes smaller. The fluctuation of the filling amount of metal halide directly influences the discharge characteristic of the lamp so that this manufacturing method leaves a significant problem.

The manufacturing method proposed in Japanese Patent Publication No. 54-14874 also has a disadvantage which cannot be overlooked. In particular, first, as the discharge lamp becomes smaller, the filling amount of a metal halide also becomes less so that the size of the metal halide becomes not easy to be dropped. In addition, it has been found that even if it is possible for the metal halide to be dropped by all means, it collides with or attaches to the wall of the light emission envelope while dropping into the envelope so that the amount of the metal halide reaching the inside of the envelope is reduced and also fluctuates to a large extent.

Therefore, a discharge lamp manufactured by this method has a fluctuation of the filling amount of the metal halide so that the fluctuation of the discharge characteristic cannot be avoided, similar to the discharge lamp manufactured by the former methods. Further, according to the above methods heretofore proposed, it is necessary to weigh the metal halide for each discharge lamp beforehand. This weighing work is also required to be carried out within the dry box and is very inefficient. Furthermore, since several types of metal halides are mixed and used in general, not only does the number of weighing operations become large, but also the amount of each metal halide becomes very small. A precise weighing operation for such a minute amount has been required. However, in practice, both a high work efficiency and weighing precision have been impossible to be realized at the same time.

SUMMARY OF THE INVENTION

It is an object of the present invention to provide a method of manufacturing a vaporized metal discharge lamp capable of solving all the prior art problems described above.

According to an aspect of this invention, a metal halide is vapor attached onto the tip of a metal rod and thereafter, the rod is inserted into the light emission envelope of the lamp and heated through high frequency induction heating to move the metal halide from the tip of the metal rod to the inside surface of the envelope.

According to a further aspect of this invention, the steps of attaching a metal halide to the tip of a rod and of inserting the rod into the light emission envelope are continuously carried out within a same container.

BRIEF DESCRIPTION OF THE DRAWINGS

FIG. 1 is a perspective view of an apparatus used to carry out the manufacturing method of this invention;

FIG. 2 illustrates the vapor deposition of a metal halide onto the tip of a metal rod;

FIG. 3 illustrates the transfer of the metal halide into the light emission envelope; and FIGS. 4 and 5 illustrate some typical metal rods, showing two rod tip configurations.

DETAILED DESCRIPTION

Referring to the figures showing an embodiment of this invention, a dry box 3 is coupled to an apparatus main body 1 with air tight means 5 interposed therebetween. After introducing inert gas such as nitrogen into the inside of the dry box 3 and releasing the air tight means 5, it becomes possible to feed a metal halide 11 within a vapor deposition source container 9 to the apparatus main body 1 without contact with the atmospheric air. The vapor deposition source container 9 can be heated with a heater (not shown) or the like and is movable in the direction indicated by the arrow A between the apparatus main body 1 and the dry box 3. A metal rod 13 mounted within the apparatus main body 1 is movable in the direction indicated by arrow B. The apparatus main body 1 is coupled to pipes 15 and 15' for exhausting gas and air respectively, which pipes are connected to gas and air exhaust pumps (not shown). The apparatus main body 1 is also provided with a head 19 for mounting a light emission envelope 21 thereto by means of a gate valve 17. Before the vapor deposition source container 9 is inserted into the apparatus main body 1, the gate valve 17 of the apparatus main body 1 is closed and the air exhaust pipe 15 is coupled to the air exhaust pump to exhaust air from within the apparatus main body 1. In addition, gas and air from within the light emission envelope 21 are exhausted through the exhaust pipe 15'. Next, the vapor deposition source container 9 is moved to the inside of the apparatus main body 1 by releasing the air tight means 5 and thereafter, the metal rod 13 is moved downward to cause a metal halide 11 to be vapor deposited onto the tip **13*a* of the metal rod 13 as shown in FIG. 2. As the metal halide 11 is heated with a heating device (not shown), it is transformed into vapor 11*a* and concentrated on the rod tip 13*a* to form a film 11*b* of metal halide. The amount of metal halide 11*b* deposited on rod tip 13*a* can be controlled precisely in accordance with the heating temperature and time. The control of the vapor deposition time may be carried out by mounting a shutter (not shown) at the hole or opening of a lid of the vapor deposition source container 9**, and by adjusting the amount of opening/closing of the shutter.

Two vapor deposition source containers 9 are shown in FIG. 1 by way of example. However, the number of containers 9 is set as desired to allow the necessary types of metal halides to be vapor deposited sequentially on the tip **13*a* of the metal rod 13. The step of vapor depositing the metal halide 11 onto the tip 13*a* of the metal rod 13 may be carried out at the same time as the step of exhausting gas and air from within the light emission envelope 21, or may be carried out in the reverse order. Next, the vapor deposition container 9 is moved to the original position (outside of apparatus main body 1) and the gate valve 17 is opened to insert the metal rod 13 into the inside of the light emission envelope 21 as shown in FIG. 3. Then, the rod 13 is heated with a high frequency induction coil 25 to then vapor deposit the entire amount of the metal halide 11*b* having been vapor deposited on the metal rod tip 13*a*, onto the inside of the envelope 21 to form a film 11*c*** (FIG. 3) of metal halide thereat.

By adjusting the temperature of the vapor deposition source container 9 and the pressure of the atmosphere in accordance with the type of metal halide, it becomes possible to exhaust gas and water contained in the metal halide. By adjusting particularly the condition for vapor depositing metal halide and the condition for exhausting gas and air, it becomes possible to control the amount of vapor deposition and exhaust gas and air at the optimum conditions. Further, attachment of the metal halide 11 to the metal rod 13 is not limited only by means of vapor deposition, but sputtering and other methods are also possible with appropriate modification of the structure of the container.

EXAMPLE

In the case where NaI is employed as one example of a metal halide, it was confirmed by experiments of the present inventors that NaI could be attached to the tip of a metal rod through vapor deposition at its melting point, i.e., 651° C. In addition, it is believed by the present inventors that the vapor deposition onto the tip of the metal rod can be practically achieved even at a temperature of about 600° C. (about 50° C. below the melting point), although measurements at this temperature were not made.

Other typical examples of metal halide fillers which can be deposited on the metal rod tip include TlI, $InI_3$ and $ScI_3$. The melting points of these typical metal halide fillers are as follows:

$InI_3$ . . . 210° C.; TlI . . . 440° C.; $ScI_3$ . . . 920° C.

In connection with these compounds, vapor deposition onto the metal rod tip is possible from temperatures at the respective melting points thereof to temperatures about 50° C. or so less than the respective melting point temperatures thereof. Deposition times should be in the range of from 1 to 2 seconds.

In the case of vacuum deposition onto the tip of the metal rod, the pressure may range from about $10^{-4}$ to about $10^{-7}$ torr.

In the case of a sputtering process for deposition onto the tip of the metal rod, the pressure may range from about $10^{-2}$ to about $10^{-3}$ torr.

Concerning the thickness of the attached metal halide, under the condition that 0.2 mg of NaI (11) was provided in one of the vapor deposition source containers 9 in a solid state, and that the surface area of the tip of the metal rod was 0.2 $mm^2$ (which corresponds to a rod diameter of 0.5 mm), the thickness of the attached metal halide thereon, when the solid state NaI (11) is vaporized, was about 0.27 mm. The temperature was set at around the melting point of the NaI and the pressure was within the range mentioned above. When the film **11*c* is formed on the inside of the bulb (see FIG. 3) the thickness of the formed metal halide film 11*c* in the bulb is different at different places on the inside of the light emission envelope 21**.

Likewise, when 0.2 mg of $InI_3$ was used, the thickness thereof deposited on the rod tip was 0.21 mm, and when 0.2 mg of TlI was used, it was 0.14 mm. Again, the temperatures were set at around the melting point of the respective metal halide, and the pressure was within the range mentioned above.

The above are typical examples. The thickness of the deposited metal halide depends at least upon the diameter of the metal rod, the shape of the tip end of the metal rod (discussed below), and the amount of metal halide used.

The above data were obtained by depositing NaI, TlI and $InI_3$ [NaI:TlI:$InI_3$=1:1:1 (weight ratio)=0.2:0.2:0.2 (mg)] on a stainless steel rod, the tip of which was substantially flat, and the diameter of which was 0.5 mm.

In another example of NaI:TlI:$InI_3$=3:1:1 (weight ratio)=0.6:0.2:0.2 (mg), the thickness values of these respective metal halides deposited on the rod tip were 0.20 mm, 0.036 mm and 0.055 mm, respectively, at the respective melting point temperatures and pressure ranges mentioned above.

When the tip of the rod is flat, the thickness of the metal halide can be simply calculated. However, when the shape of the rod tip is, for example, as shown in FIG. 4 or FIG. 5, the exact calculation of the metal halide thickness is difficult. When a thin rod must be used, it preferably has the rod tip structure shown in FIG. 4 or 5.

When the metal halide film 11*c* is deposited on the inside of the light emission envelope 21 (see FIG. 3), the following conditions are preferred:

Temperatures:

$InI_3$ . . . 210° C.

TlI . . . 440° C.

$ScI_3$ . . . 920° C.

Pressures: $10^{-3}$ to $10^{-7}$ torr

Deposition Times: Less than 1 second

According to the present invention, all of the processes of exhausting gas and air contained in the metal halide, weighing the metal halide, and feeding it into the light emission envelope can be carried out continuously within the sealed container shielded from external air, without leaving a chance of contacting with impurity gas and moisture. Further, since jigs do not contact external air, it is possible to avoid secondary contact of the metal halide with external air. As a result, the conventional disadvantages including an extraordinarily high discharge start voltage, blackening of the envelope wall, and inactivation of the lamp can be eliminated. Furthermore, in manufacturing a small size discharge lamp which uses only a small amount of metal halide to be filled in the envelope, the amount of deposition onto the metal rod can be precisely controlled by maintaining constant the work conditions such as temperature, pressure and the like. Thus, the fluctuation normally caused by a fluctuation of the filling amount can be eliminated. Still further, the steps of exhausting air from within the envelope, weighing the metal halide, and feeding it to the inside of the envelope can be carried out continuously, thereby realizing a very efficient method of manufacturing a vaporized metal discharge lamp.

Although the present invention has been fully described in connection with a preferred embodiment thereof with reference to the accompanying drawings, it will be apparent to those skilled in the art that various changes and modifications of the present invention are possible within the scope of the following claims.

What is claimed is:

1. A method of manufacturing a vaporized metal discharge lamp, comprising:

locating a source of metal halide in a container having an opening therein;

locating a metal rod and said container with said metal halide therein in an air evacuated chamber;

moving said metal rod through said opening and at least partially into said container so that at least a tip end of said metal rod is in said container;

causing said metal halide in said container to deposit onto said tip of said metal rod in said container so as to attach a layer of metal halide onto said tip of said metal rod then removing said tip of said metal rod from said container;

inserting at least said tip of said metal rod, with said metal halide layer attached thereto, into the inside of an air evacuated light emission envelope of said lamp, said lamp envelope being coupled to said air evacuated chamber so as to be air evacuated therewith; and then transferring said metal halide layer from said tip of said metal rod to the inside surface of said air evacuated envelope, while at least said tip of said metal rod is in said envelope, by at least heating of at least said tip of said metal rod with said layer of metal halide thereon.

2. The method of claim 1, wherein said step of attaching said layer of metal halide to said tip of said metal rod and said step of inserting at least said tip of said metal rod into the inside of said envelope are carried out within a same air evacuated chamber.

3. The method of claim 1, wherein said step of causing said metal halide in said container to deposit onto said tip of said metal rod comprises carrying out vapor deposition of said metal halide in said container.

4. The method of claim 1, wherein said step of causing said metal halide in said container to deposit onto said tip of said metal rod comprises carrying out sputtering of said metal halide in said container.

5. The method of claim 4, wherein said step of heating at least said tip of said metal rod to transfer said metal halide layer from tip of said metal rod to the inside surface of said air evacuated envelope comprises high frequency induction heating.

6. The method of claim 3, wherein said step of heating at least said tip of said metal rod to transfer said metal halide layer from tip of said metal rod to the inside surface of said air evacuated envelope comprises high frequency induction heating.

7. The method of claim 1, wherein said step of heating at least said tip of said metal rod to transfer said metal halide layer from tip of said metal rod to the inside surface of said air evacuated envelope comprises high frequency induction heating.

8. The method of claim 2, wherein said steps of depositing said metal halide layer onto said tip of said metal rod, and said step of inserting at least tip of said metal rod into the inside of said air evacuated envelope of said lamp are carried out continuously.

9. The method of claim 1, wherein said steps of depositing said metal halide layer onto said tip of said metal rod, and said step of inserting at least tip of said metal rod into the inside of said air evacuated envelope of said lamp are carried out continuously.

10. The method of claim 1, further comprising the step of moving said container containing said source of metal halide therein from a work station to said chamber; closing off said chamber; and then air evacuating said chamber with said container and said metal rod therein.

11. The method of claim 10, further comprising connecting said lamp envelope to said chamber, and air evacuating said envelope via said chamber.

12. The method of any one of claims 1–11, wherein said step of locating a source of metal halide in said container comprises locating at least one metal halide of the group consisting of TlI, $InI_3$ and $ScI_3$ in said container.

13. The method of claim 12, wherein said metal rod is made of stainless steel.

14. The method of claim 1, wherein said metal rod is made of stainless steel.

15. The method of claim 1, wherein said metal halide deposited onto said tip of said metal rod in said container is deposited to a thickness of between about 0.055 mm and about 0.27 mm.

* * * * *